United States Patent [19]

Gentry et al.

[11] Patent Number: 4,900,261

[45] Date of Patent: Feb. 13, 1990

[54] ELECTRICAL CONNECTOR SYSTEM

[75] Inventors: John T. Gentry; Mark R. Martin, both of Springfield, Mo.

[73] Assignee: Positronic Industries, Inc., Springfield, Mo.

[21] Appl. No.: 315,346

[22] Filed: Feb. 23, 1989

[51] Int. Cl.[4] ..... H01R 13/627

[52] U.S. Cl. ..... 439/353; 439/357; 439/680

[58] Field of Search ..... 439/350, 351, 352, 353, 439/354, 355, 356, 357, 358, 677–681, 79, 80

[56] References Cited

U.S. PATENT DOCUMENTS

| | | | |
|---|---|---|---|
| 2,760,174 | 8/1956 | Burtt et al. | 339/91 |
| 3,112,974 | 12/1963 | Curtis et al. | 439/680 X |
| 3,149,897 | 9/1964 | Martineck | 339/176 |
| 3,399,374 | 8/1968 | Pauza et al. | 339/91 |
| 3,407,380 | 10/1968 | Krehbiel | 339/186 |
| 3,605,070 | 9/1971 | Krafthefer | 339/91 R |
| 4,229,064 | 10/1980 | Vetter et al. | 439/680 |
| 4,299,433 | 11/1981 | Jayne | 339/91 R |
| 4,433,888 | 2/1984 | Winger | 339/91 R |
| 4,449,767 | 5/1984 | Weidler | 439/681 X |

OTHER PUBLICATIONS

"MR Miniature Rectangular Connectors", (Cat. 73–168, rev. 11–84), by AMP, Inc., Harrisburg, Pa., dated 1984.

"AMP", catalog by AMP, Inc., Harrisburg, Pa., dated 1984.

"Molex Full Line Catalog #870", by Molelx, Circa 1986.

"Burndy, the Connector Selector", Burndy Corp., Norwalk, Conn., 1986.

"Power–Latch, Power Connector & PCB Header System", Methode Electronics, Inc., 1987.

"Amphenol Industrial Line Connectors", by Amphenol, 10/82.

"POWERCON Locking Conectors Series 9090", by ELCo., 1986.

*Primary Examiner*—Neil Abrams

*Assistant Examiner*—Khiem Nguyen

*Attorney, Agent, or Firm*—Senniger, Powers, Leavitt and Roedel

[57] ABSTRACT

An electrical connector system with a discriminating latching feature comprising a first electrical connector having female contacts and a first latching member, a second electrical connector having male contacts and a second latching member, a third electrical connector having female contacts and a third latching member, and a fourth electrical connector having male contacts and a fourth latching member. The second and fourth connectors may be plugged into either of the first and third connectors so that respective male and female contact make electrical contact with one another. The latching members are cooperable with one another to latch together the first and second connectors to one another when plugged together, to latch the first and fourth connectors to one another when plugged together, to latch the second and third connectors to one another when plugged together, but not to latch the third and fourth connectors to one another when plugged together.

19 Claims, 2 Drawing Sheets

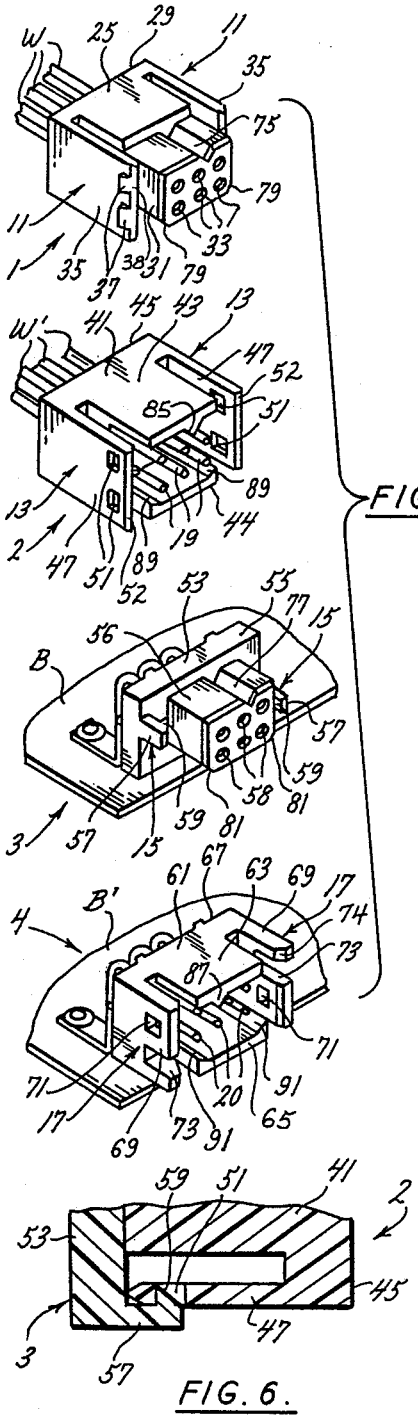
FIG. 1.
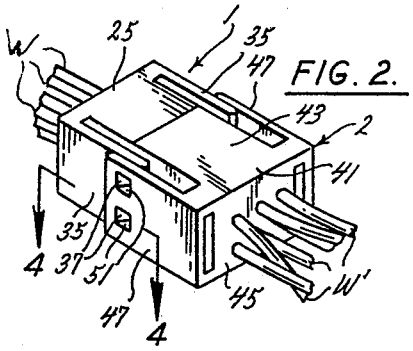
FIG. 2.
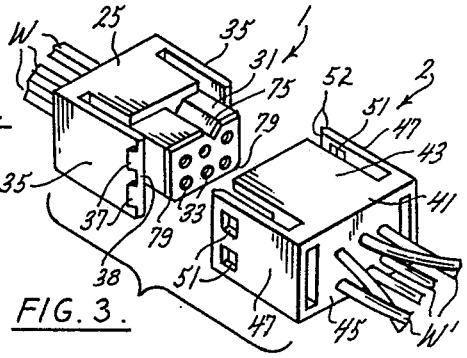
FIG. 3.
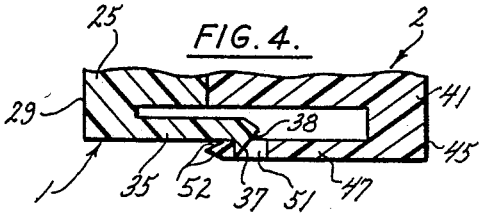
FIG. 4.
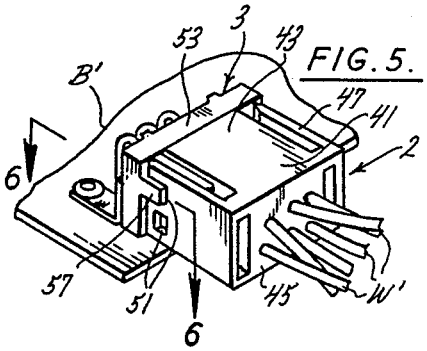
FIG. 5.
FIG. 6.

FIG. 7.
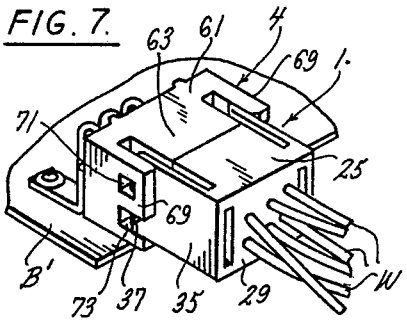
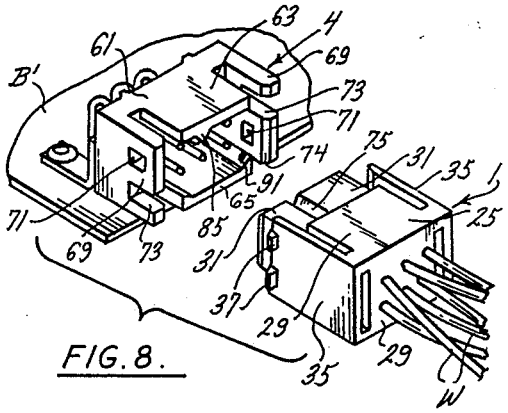
FIG. 8.
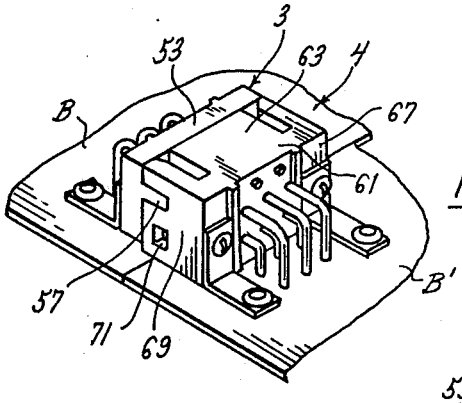
FIG. 9.
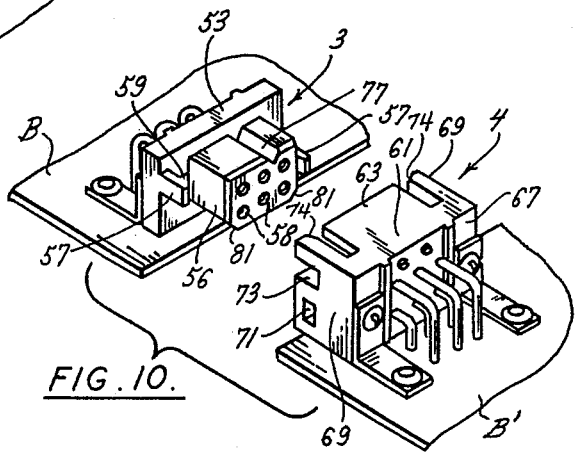
FIG. 10.

ELECTRICAL CONNECTOR SYSTEM

BACKGROUND OF THE INVENTION

This invention relates generally to disengageable electrical connectors of the multiple circuit type and more specifically to a system of such electrical connectors having a discriminating latching feature.

Electrical connectors of the multiple circuit type have previously been provided in two styles, one having latches for positive latching of the connectors when plugged together and the other without such latches. Because cables are often subjected to forces tending to unplug the connectors, latching of the two connectors is often desirable when a cable connector is connected to another cable connector or to a printed circuit board connector. However, because printed circuit boards are typically not subjected to forces tending to pull them apart and because latching may unduly hinder later disconnection of the boards, latching of the two connectors is usually not desirable when two printed circuit board connectors are connected.

Depending upon the application, therefore, it has previously been necessary for the user to select the proper style of connector. When connection was to be made between a first cable connector and a second cable connector, or between the first cable connector and a printed circuit board connector, the user would select a style of connectors having a latch. When connection was to be made between two printed circuit board connectors, the user selected a style of connectors not having a latch.

Consequently, it has previously been necessary for the user to have two different styles of connectors in stock. In addition, there is the constant risk that a user will select a style of connector that may be inappropriate for the application, i.e., the user may select connectors having latches when it would be preferable that the connectors not be latched together or the user may select connectors not having latches when it would be preferable that the connectors be latched together. Further, no system of connectors has been provided where the connectors have latching features that discriminate between connections where it is desired for the connectors to be latched and those where it is undesirable for the connectors to be latched, and where the connectors are adapted for latching and unlatching without the use of tools.

SUMMARY OF THE INVENTION

Among the several objects of this invention may be noted that provision of an improved system of electrical connectors, a system of electrical connectors in which the two connectors will latch when certain predetermined connectors are plugged together but not when other predetermined connectors are plugged together; and the provision of such electrical connectors adapted to easily latch and unlatch to one another without the use of tools.

Generally, the electrical connector system of this invention comprises a first electrical connector having female contacts and first latching means, a second electrical connector having male contacts and second latching means, a third electrical connector having female contacts and third latching means and a fourth electrical connector having male contacts and fourth latching means. The second and fourth connectors having male contacts are adapted to plug into either of said first and third connectors having female contacts so that respective male and female contacts make electrical contact with one another. The latching means of each connector is cooperable with the latching means of the other connectors to latch the first and second connectors to one another when plugged together, to latch the first and fourth connectors to one another when plugged together and to latch the second and third connectors together when plugged together. However, the latching means of the third connector and the latching means of the fourth connector are not cooperable to latch to one another when the third and fourth connectors are plugged together.

Other objects and features will be in part apparent and in part pointed out hereinafter.

BRIEF DESCRIPTION OF THE DRAWINGS

FIG. 1: A perspective of a system of electrical connectors of this invention;

FIG. 2: A perspective of the first and second electrical connectors of FIG. 1 plugged together;

FIG. 3: A perspective view of the first and second electrical connectors of FIG. 2 unplugged from one another;

FIG. 4: A fragment of a section taken on line 4—4 of FIG. 2 showing the interconnection of the latching means;

FIG. 5: A perspective of the second and third electrical connectors of FIG. 1 plugged together;

FIG. 6: A fragment of a section taken on line 6—6 of FIG. 5 showing the interconnection of the latching means;

FIG. 7: A perspective of the first and fourth electrical connectors of FIG. 1 plugged together;

FIG. 8: A perspective of the first and fourth electrical connectors of FIG. 7 unplugged from one another;

FIG. 9: A perspective of the third and fourth electrical connectors of FIG. 1 plugged together;

FIG. 10: A perspective of the third and fourth electrical connectors of FIG. 9 unplugged from one another;

Corresponding reference characters indicate corresponding parts throughout the several views of the drawings.

BRIEF DESCRIPTION OF A PREFERRED EMBODIMENT

Referring now to the drawings, an electrical connector system, as shown in FIG. 1, having a discriminating latching feature includes first through fourth connectors, generally indicated at 1, 2, 3 and 4 respectively. The connectors have first through fourth latching means, indicated generally at 11, 13, 15 and 17 respectively, each associated with the respective first through fourth connector. The first and third connectors have male pin contacts 19, 20 and the second and fourth have female pin contacts (not shown). The second and fourth connectors are each adapted to be plugged into either of the first and third connectors so that respective male and female contacts make electrical contact with one another. As will be more fully described below, the latching means of each of the connectors are cooperable with one another to latch the first and second connectors to one another when they are plugged together, to latch the first and fourth connectors to one another when plugged together, and to latch the second and third connectors when plugged together. However, the latching means 15 of the third connector is not cooperable with the latching means 17 of the fourth connector to latch together the third and fourth connectors when plugged together.

The first connector 1 has a generally rectangular body 25 of molded insulating plastic material including a back wall 29 and contact terminal housing 31 projecting forward from the back wall. The outward facing surface of the back wall receives the terminal ends of the wires W of a cable which are joined with the female contacts in the connector body. Openings 33 in the front wall of the terminal housing 31 receive the male contacts 19, 20 of either of the second and fourth connectors 2, 4 for engagement in the female contacts. The first latching means 11 includes two substantially identical tongues 35, integrally formed with the body 25, which project forward from the back wall 29 on opposite sides of the body. Adjacent the distal end of each of the tongues 35 are two outwardly projecting raised portions or studs 37, constituting first stud means, which are in side by side relationship with one another. The forward facing surface of each tongue is beveled to provide a generally outwardly facing oblique surface 38 which includes the forwardmost surface of the studs 37. The tongue 35 comprise the first flexibly resilient snap-acting detent means in this embodiment.

The second connector 2 has a generally rectangular body 41 of molded insulating plastic material including a top wall 43, a bottom wall 44 and a back wall 45. The rearward facing surface of the back wall receives the terminal end of the wires W' of a cable which are joined with the male contacts 19 in the connector body. The second latching means 13 includes two substantially identical tongues 47, which are integrally formed with the body 41 and project forward from the back wall 45 on opposite sides of the body. There are two apertures 51 in each tongue, constituting first aperture means, located adjacent the distal end of the tongue which are in side by side relationship with one another. The distal end of each tongue is beveled such that there are inwardly and outwardly facing oblique surfaces 52 which intersect one another at along a line to form a forward edge of each tongue. The tongues 47 comprise the second flexibly resilient snap-acting detent means in this embodiment.

The third connector 3 has a generally rectangular body 53 of moled insulating plastic material including a base 55 and contact terminal housing 56 projecting forward from the base. Openings 58 in the front wall of the terminal housing 56 receive male contacts 19, 20 of either of the second and fourth connectors 2, 4 for engagement in the female contacts of the third connector. The third latching means 15 includes two substantially identical tongues 57, integrally formed with the base, which project forward from the base. The width of the tongues 57 is substantially less than the width of the connector body 53, and the tongues are located adjacent diagonally opposite corners of the connector 3. The tongues have inwardly projecting raised portions or studs 59, constituting second stud means, located generally adjacent their distal ends. The tongues 59 comprise the third relatively inflexible detent means in this embodiment.

The fourth connector 4 has a generally rectangular body 61 of molded insulating plastic material including a top wall 63, a bottom wall 65 and a back wall 67. The fourth latching means 17 includes two substantially identical tongues 69, integrally formed with body 61, which project forward from the back wall 67 on opposite sides of the body. The tongues each have an aperture 71, constituting second aperture means, and a notch 73 adjacent their distal ends with the aperture and notch being in side by side relationship with one another. The apertures 71 are located adjacent diagonally opposite corners of the body 61, as are the notches 73. The tongues each have a forward facing surface with a beveled inside edge providing a generally inwardly facing oblique surface 74. The tongues 69 comprise the fourth relatively inflexible snap-acting detent means in this embodiment. The contacts of the third and fourth connectors, 3, 4, as shown in the drawings, extend through the back and are curved downward for connection to circuit boards B, B' so that the connectors are oriented for side-board mounting to other connectors. However, the connector system of this invention is equally applicable for board connectors oriented with the back wall parallel with the board, for connecting boards in a stack or for mother-daughter board connections.

For cable to cable connection using the connectors of this invention, the first and second connectors 1, 2 are plugged together (FIGS. 2 and 3). The tongues 35 of the first connector are resiliently flexible so that when the first and second connector are mated, the tongues may flex inwardly so that they are received inside the tongues 47 of the second connector. The relative longitudinal separation of the tongues 35, 47 on their respective bodies 25, 41 is such that the initial contact of the connectors is at their oblique surfaces 38, 52. The oblique surfaces 38 slide inwardly along the oblique surfaces 52 as the first and second connectors are plugged together, causing the tongues 35 of the first connector to flex inwardly for reception inside the tongues 47 of the second connector. The studs 37 slide along the tongue 47 until they reach the apertures 51 of the tongue 47 and then snap into the apertures as the resilient tongue 35 returns substantially to its unflexed position for releasable snap-latch interengagement of the connectors. However, a slight flexure of the tongues 35 is maintained so that the tongues apply an outward force to hold the studs 37 in the apertures 51 of the second connector (FIG. 4). The connectors may be unlatched for unplugging by grasping the tongues 35 of the first connector between the thumb and index finger and squeezing to cause the tongues 35 to flex inwardly so that the studs 37 are withdrawn from the apertures 51.

Similarly, for cable to board connection, the relative longitudinal separation of the tongues 35, 69 of the first and fourth connector on their respective bodies 25, 61 is such that the initial contact of the connectors is between the generally outwardly facing oblique surfaces 38 of the first connector 1 and the generally inwardly facing oblique surfaces 74 of the fourth connector 4. The oblique surfaces 38 of the first connector slide inwardly over the oblique surfaces 74 as the connectors are plugged together causing the tongues 35 to flex inwardly for reception inside the relatively inflexible tongues 69 of the fourth connector (FIGS. 7 and 8). One of the studs 37 on each of the tongues then slides along the tongue 69 until it becomes aligned with the aperture 71 in the tongue 69 of the fourth connector and snaps into the aperture 71 for releasable snap-latch interengagement of the connectors. The tongues 35 return substantially to their unflexed positions, but remain slightly flexed so that they apply an outward force to keep the studs 37 in the apertures 71. The studs 37 not received in the apertures 71 are received in the notch 73 of the fourth connector and do not interengage the connectors. The connectors may be unlatched by squeezing the tongues 35 of the first connector inwardly as described above to withdraw the studs 37 from the apertures 71.

The tongues 47 of the second connector 2 are also resiliently flexible and may be bent inwardly when the second and third connectors are plugged together (FIG. 5) to be received inside of the relatively inflexible tongues 57 of the third connector 3. The relative longitudinal separation of the tongues 47, 57 of the second and third connectors on their respective bodies 41, 53 is such that the generally outwardly facing oblique surfaces 52 of the tongues 47 engage the generally inwardly facing oblique surfaces of the studs 59, of the third connector. The engagement of the surfaces causes the tongues 47 of the second connector to flex inwardly as the connectors are plugged together for reception inside of the relatively inflexible tongues 57 of the third connector. The tongues 47 of the second connector slide along the oblique surfaces of the studs 59 of the third connector until the one of the apertures 51 of each tongue 47 becomes aligned with the stud 59 and the tongues 47 snap outwardly to receive the stud 59 in the aperture 51 for releasable snap-latch interengagement of the connectors. The tongues 47 return substantially to their unflexed positions, but remain slightly flexed so that they apply an outward force to keep the studs 59 in the apertures 51. The connectors may be unlatched for unplugging by grasping the tongues 47 of the second connector between the thumb and index finger and squeezing to cause the tongues 47 to flex inwardly so that the apertures 51 clear the studs 59 of the third connector.

The third and fourth connectors are plugged together (FIGS. 9 and 10) when board to board connection is required. The tongues 57 of the third connector are received in the notches 73 of the tongues 69 of the fourth connectors so that there is no latching of the connectors although plugged together. Latching for board to board connections is unnecessary because the board themselves are held in fixed position such that there is relatively little movement between them. In addition, where the boards connected together in stacks it is very difficult to reach between the boards to release the latching mechanism.

The connectors are also provided with registration means for restricting their orientation when they are pluggged together to assure that predetermined male contacts 19, 20 of the second and fourth connectors are received in predetermined female contacts of the first and third connectors to prevent a short circuit which could damage the connected electrical equipment. The first and third connectors each have a V-shaped groove 75, 77 in the top wall of the contact terminal housing 31, 56, the groove extending in a front to back direction. The lower corners 79, 81 of each contact terminal housing are beveled. The top walls 43, 63 of the second and fourth connectors extend forward from the back wall 45, 67 to form, along with the tongues 47, 69, a hood surrounding the exposed portions of the male contacts 19, 20 extending forward out of the connector bodies 41, 61. The contact terminal housing of either of the first and third connectors is received between the top and bottom wall of either of the second and fourth connectors when plugged together. The inner surface of the top walls 43, 63 of the second and fourth connectors have a raised portions or bosses 85, 87 of V-shaped cross section which are located in the middle of the top walls and extend in a front to back direction. The bottom walls 44, 65 are raised in an inward direction at their edges and form inwardly facing flat surfaces 89, 91 which lie in planes at oblique angles with respect to the top and bottom walls of the connector bodies 41, 61. The bosses 85, 87 and raised edges 89, 91 of the second and fourth connectors provide guideways for the terminal housings 31, 56 when plugged into either of the first and third connectors. Connectors may not be plugged together unless oriented so that the boss registers in the V-shaped notch and the beveled corners are adjacent the angled flat surfaces of the bottom wall.

Thus is provided a system of four electrical connectors with a discriminating latching feature. By predetermined arrangement, the connectors are operable to latch to one another when cable is plugged into cable and cable into board, but not when board is plugged into board. For connections operable to latch, the latching occurs automatically when the connectors are plugged together because the longitudinal separation of the tongues on each connector is such that the oblique surfaces of their tongues interact to cause a relative motion of the tongues which latches the connectors. The latched connectors may be unlatched by simply squeezing the tongues which are received on the inside of the tongues of the other connector when latched, such that latching and unlatching is accomplished without any tools.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An electrical connector system with a discriminating latching feature, said system comprising:

a first electrical connector having female contacts and first latching means;

a second electrical connector having male contacts and second latching means;

a third electrical connector having female contacts and third latching means; and a fourth electrical connector having male contacts and fourth latching means;

said second and fourth connectors with male contacts each being adapted to plug into either of said first and third connectors with female contacts so that respective male and female contacts make electrical contact with one another, said latching means of each said connector being cooperable with the latching means of other of said connectors to latch said first and second connectors to one another when plugged together, to latch said first and fourth connectors to one another when plugged together, and to latch said second and third connectors to one another when plugged together, but not to latch said third and fourth connectors to one another when plugged together.

2. An electrical connector system as set forth in claim 1 wherein said first latching means and said second latching means are adapted for releasable snapping interengagement thereby to releasably snap-latch said first and second connectors to one another when plugged together.

3. An electrical connector system as set forth in claim 2 wherein said first latching means and said fourth latching means are adapted for releasable snapping interengagement thereby to releasably snap-latch said first and fourth connectors to one another when plugged together.

4. An electrical connector system as set forth in claim 3 wherein said second latching means and said third latching means are adapted for releasable snapping interengagement thereby to releasably snap-latch said second and third connectors to one another when plugged together.

5. An electrical connector system as set forth in claim 4 wherein said first latching means comprises first flexibly resilient snap-acting detent means and said second latching means comprises second flexibly resilient snap-acting detent means interengageable with said first snap-acting detent means for releasably snap-latching said first and second connectors together.

6. An electrical connector system as set forth in claim 5 wherein said third latching means comprises third relatively inflexible detent means engageable with said second flexibly resilient snap-acting detent means for releasably snap-latching said second and third connectors together.

7. An electrical connector system as set fourth in claim 6 wherein said fourth latching means comprises fourth relatively inflexible detent means engageable with said first flexibly resilient snap-acting detent means for releasably snap-latching said first and fourth connectors together.

8. An electrical connector system as set forth in claim 7 wherein said first detent means comprises at least one tongue attached at one end to said first electrical connector, the tongue having first stud means therein disposed generally adjacent its distal end.

9. An electrical connector system as set forth in claim 8 wherein said second detent means comprises at least one tongue attached to one end to said second electrical connector, the tongue having first aperture means disposed generally adjacent its distal end, the first aperture means being adapted for receiving the first stud means of said first connector to releasably latch said first and second connectors to one another when plugged together.

10. An electrical connector system as set forth in claim 9 wherein said third detent means comprises at least one tongue attached at one end to said third electrical connector, the tongue having second stud means disposed generally adjacent its distal end, the first aperture means of said second connector being adapted for receiving the second stud means of said third connector to latch said second and third connectors to one another when plugged together.

11. An electrical connector system as set forth in claim 10 wherein said fourth latching means comprises at least one tongue attached at one end to said fourth electrical connector, the tongue having second aperture means generally disposed adjacent its distal end, the second aperture means being adapted for receiving the first stud means of said first connector to latch said first and fourth connectors to one another when plugged together, but not being adapted for receiving the second stud means of said third connector to latch said third and fourth connectors to one another when plugged together.

12. The electrical connector system as set forth in claim 11 wherein the first stud means of said first connector comprises two studs projecting outwardly from the tongue attached to said first connector and disposed in generally side by side relationship to one another adjacent the distal end of said tongue.

13. The electrical connector system as set forth in claim 12 wherein the first aperture means of said second connector comprises two apertures in the tongue attached to said second connector disposed in generally side by side relationship to one another generally adjacent the distal end of the tongue.

14. The electrical connector system as set forth in claim 13 wherein the second stud means of said third connector comprises a stud projecting inwardly from adjacent the distal end of the tongue attached to the third connector.

15. The electrical connector system as set forth in claim 14 wherein the second aperture means of said fourth connector comprises an aperture in the tongue attached to said fourth connector adjacent the distal end of said tongue.

16. The electrical connector system as set forth in claim 15 wherein:

the tongue of the first connector is adapted to resiliently flex for snapping of its two studs into the corresponding apertures of the tongue of the second connector when said first and second connectors are plugged together and for withdrawal of the studs from the apertures for unlatching said first and second connectors to enable the connectors to be unplugged, and for snapping of one of its two studs into the aperture in the tongue of the fourth connector when said first and fourth connectors are plugged together and for withdrawal of said one stud from said aperture for unlatching said first and fourth connectors to enable the connectors to be unplugged;

the tongue of said second connector is adapted to resiliently flex for snapping of the stud of said third connector into one of its apertures to latch together said second and third connectors when plugged together, and for withdrawal of said stud from said aperture for unlatching said second and third connectors to enable the connectors to be unplugged; and wherein the tongue of the fourth connector has a notch generally adjacent the aperture adjacent the distal end of said tongue for receiving the tongue of said third connector when said third and fourth connectors are plugged together.

17. The electrical connector system as set forth in claim 15 wherein:

said first connector comprises a generally rectangular body and two substantially identical tongues attached to the body at opposite ends thereof;

said second connector comprises a generally rectangular body and two substantially identical tongues attached to the body at opposite ends thereof;

said third connector comprises a generally rectangular body and two substantially identical tongues attached to the body at adjacent diagonally opposite corners of said third connector; and said fourth connector comprises a generally rectangular body and two substantially identical identical tongues attached to the body at opposite sides thereof, said apertures in the tongues being disposed adjacent diagonally opposite corners of said fourth connector.

18. The electrical connector system as set forth in claim 17 wherein the system further comprises registration means operable to restrict each of said first and third connectors to a single predetermined orientation relative to each of said second and fourth connectors when either of said first and third connectors is plugged into either of said second and fourth connectors, whereby predetermined male contacts of either of the second and fourth connectors are received in predetermined female contacts of either of the first and third connectors.

19. The electrical connector system as set forth in claim 1 wherein the system further comprises means for restricting each of said first and third connectors to a single orientation relative to each of said second and fourth connectors when either of said first and third connectors is plugged into either of said second and fourth connectors, whereby predetermined male contacts of either of the second and fourth connectors are received in predetermined female contacts of either of the first and third connectors.

* * * * *